United States Patent [19]

Vandebult

[11] 4,356,477

[45] Oct. 26, 1982

[54] FM/AM ELECTRONIC SECURITY SYSTEM

[76] Inventor: Jan Vandebult, 32 Averill St., Topsfield, Mass. 01983

[21] Appl. No.: 192,369

[22] Filed: Sep. 30, 1980

[51] Int. Cl.[3] ..... G08B 13/24

[52] U.S. Cl. ..... 340/572; 340/568; 340/539

[58] Field of Search ..... 340/505, 524, 539, 552, 340/561, 567, 568, 571, 572, 694, 695, 696

[56] References Cited

U.S. PATENT DOCUMENTS

| | | | |
|---|---|---|---|
| 3,798,642 | 3/1974 | Augenblick et al. | 340/572 |
| 3,806,905 | 4/1974 | Strenglein | 340/58 |
| 3,810,147 | 5/1974 | Lichtblau | 340/572 |

*Primary Examiner*—Alvin H. Waring

*Attorney, Agent, or Firm*—Schwartz, Jeffery, Schwaab, Mack, Blumenthal & Koch

[57] ABSTRACT

An electronic security system utilizing a transmitter and receiver in combination with a resonant tag circuit which is responsive to at least one frequency of electromagnetic radiation. The transmitter provides electromagnetic radiation in a predetermined area at a frequency close to the resonant frequency of the resonant tag circuit. The transmitter additionally modulates its frequency with a detection modulation frequency $F_d$. The receiver is responsive to electromagnetic radiation and picks up at least a component of the detection modulation frequency $F_d$. In a preferred embodiment, this component is an AM signal radiated by the resonant tag circuit when the tag circuit is in turn activated by the frequency modulated transmitter frequency. A detection logic circuit responsive to the presence of AM signal at frequency $F_d$, signals an appropriate alarm. Additional embodiments utilize varying transmitter frequencies and numbers of resonant frequencies in each tag to permit wide application of the security system not only to prevent theft or surreptitious removal of objects but also to permit rapid effective identification of individuals and to provide access to security areas to properly identify individuals.

22 Claims, 10 Drawing Figures

FM/AM ELECTRONIC SECURITY SYSTEM

BACKGROUND OF THE INVENTION

The present invention relates generally to electronic security systems and more specifically to RF systems for the reliable detection of the presence of a resonant tag circuit.

Known in the prior art is the use of a tuned tank circuit comprising an inductor with a capacitor connected across the inductor terminals for the purpose of either modifying transmissions from an antenna or retransmitting at its resonant frequency a signal which is then received and amplified. A typical prior art system is disclosed in U.S. Pat. No. 3,818,472, issued June 18, 1974 to Mauk et al. Here, the resonant tank circuit is tuned to the preselected frequency of the transmitter and upon energization, by the transmitter's broadcasting at the preselected frequency, the tank circuit, by ringing action, retransmits a signal which is detected in the receiver. Thus, if the signal is detected in the receiver an alarm is set off to indicate the presence of the tank circuit in the preselected monitoring zone. Difficulties in the Mauk arrangement arise when the tag circuit's resonant frequency is not precisely the same as the transmitter frequency. There may be little or no energization with a corresponding lack of retransmission. This device in operation requires careful quality control to ensure that all of the resonant tank circuit equipped tags (which may be applied to any article whose unauthorized passage through the monitored area is to be noted) are resonant at precisely the transmitter's frequency.

A further difficulty in this type of security system is that extraneous signals having the frequency of the resonant tag, will energize the receiver even when a tag is not present causing a false alarm. Where such tags are utilized to protect merchandise in a store, such false alarms would be very destressing to customers who happen to be passing through the monitored area at the time of the false alarm.

In U.S. Pat. No. 3,696,379 to Minasy issued Oct. 3, 1972, an attempt has been made to eliminate the effects of spurious radiation by supplying a second receiving antenna just outside the monitoring area in order to deactivate the monitoring area receiver system when spurious radiation having the same frequency as the resonant tag is received by the outside antenna. This of course requires two separate receiving antennas placed some distance apart and may be a rather awkward arrangement for modern merchandising techniques.

The problem of quality control in the resonant tag can be partially compensated for by the use of a swept frequency transmitter such as that disclosed in Lichtblau, U.S. Pat. No. 4,117,466 issued Sept. 26, 1978. Although Lichtblau is directed to a complex electronic system for factoring out beat frequency signals caused by simultaneous transmission from an outside transmitter, the basic concept sweeps the monitoring transmitter through a range of frequencies with the resonant frequency of the tag being within the range. Resonation of the tag, when its particular resonant frequency is transmitted, is sensed by the receiver and provides an output alarm indication.

In most swept frequency transmitter security systems the receiver senses a change in the electromagnetic field caused by the resonant tag absorbing energy when interrogated at its resonant frequency. This sensing is a major drawback in such systems in that they must rely upon a relatively small change in field loading which takes the form of a small change in amplitude of the received signal in order to determine the presence of the resonant tag in the predetermined monitoring area. Another problem with this technique is the change in received signal due to different orientations of the resonant tag in the electromagnetic field. It is thus very difficult to distinguish a genuine pulse from interferring pulses without generating a substantial number of false alarms.

SUMMARY OF THE INVENTION

It is therefore an object of the present invention to provide an electronic security system which does not rely upon detection of changes in the transmitted frequency field loading in detection of the presence of a resonant tag.

It is a further object of the present invention to provide an electronic security system which is effective yet tolerant of minor deviations in the resonant frequency of resonant tags utilized in conjunction therewith.

It is a still further object of the present invention to provide an electronic security system which positively identifies the presence of a resonant tag in its predetermined monitoring area.

The above and other objects are achieved by providing a transmitter capable of providing an electromagnetic field in a predetermined area at at least one frequency, said transmitter including frequency modulating the output thereof with a detection modulation frequency $F_d$. A receiver is provided for detecting a signal which comprises at least one component of the detection modulation frequency $F_d$ in the predetermined area. In conjunction with the transmitter and receiver, a resonant tag circuit is utilized which has at least one resonant frequency close to the transmitter frequency. In specific embodiments of the present invention, the component of the detection modulation $F_d$ is an AM signal having a frequency equal to $F_d$ or harmonics of $F_d$. In another embodiment, the component of the detection modulation $F_d$ is the phase changes, relative to the transmitter frequency, occurring at the detection modulation frequency $F_d$ which are utilized to provide an indication of the presence of a resonant tag. Further embodiments include cycling either the transmitter or the modulation frequency $F_d$ on and off in a predetermined sequence to verify that the received signal is indeed caused by the presence of a resonant tag and not by spurious external transmissions.

BRIEF DESCRIPTION OF THE DRAWINGS

A more complete appreciation of the invention and the attendant advantages thereof will be more clearly understood by reference to the following drawings, wherein.

DETAILED DESCRIPTION OF A PREFERRED EMBODIMENT

Figure 1:
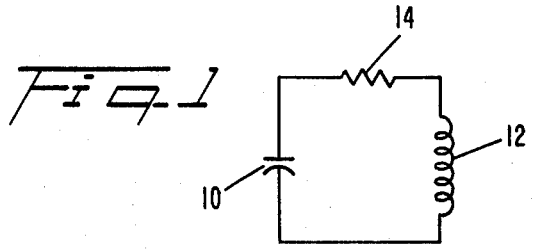
FIG. 1 is an electrical schematic of a resonant tag.

Referring now to the drawings wherein like reference characters designate like parts throughout the several views, FIG. 1 is an electrical schematic of the resonant tank circuit incorporated into a typical tag. A capacitor 10 is connected in series with inductor 12, with resistance 14 indicative of the resistance in the circuit. When excited by externally applied electromagnetic field radiation, the tank circuit of FIG. 1 will resonate at its resonant frequency $F_r$ with the maximum amplitude of the resonation determined by the strength and frequency of the exciting field and the component values of the capacitor, the inductor and the internal resistance in the circuit.

Figure 2:
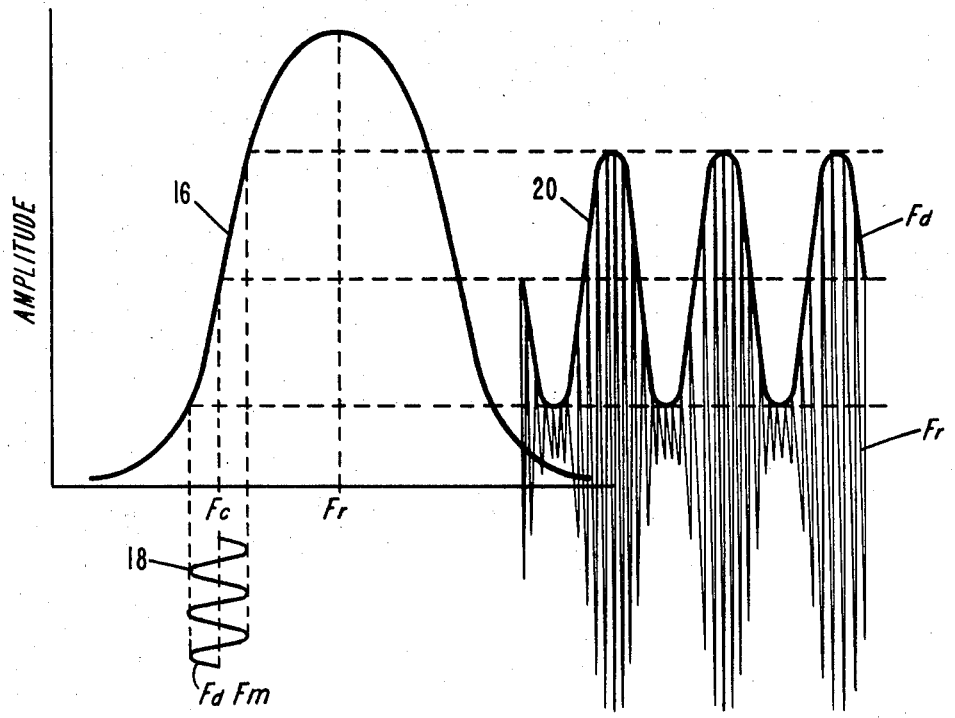
FIG. 2 is a graph of frequency versus amplitude for signals received by the resonant tag (For one particular orientation of the tag)

FIG. 2 plots amplitude versus frequency in solid line 16 for the resonant circuit whose resonant frequency is $F_r$. It can be seen that if the excitation frequency is not precisely on the resonant frequency $F_r$ of the tank circuit, the tank circuit will still resonate at its resonant frequency but with a lower amplitude. If a signal having a frequency $F_c$ were applied to the tank circuit, the tank circuit output would be as indicated by line 16 and would be dependent on where $F_c$ is in relation to the resonant frequency $F_r$ of the tank circuit. However, if this frequency $F_c$ were frequency modulated (FM) with a detection modulation frequency $F_d$, it can be seen that the frequency applied to the tank circuit would vary over a range of frequencies and would vary at a frequency equal to $F_d$, the detection modulation frequency, as shown by curve 18.

Because the amplitude of oscillations in the resonant tank circuit depend on the excitation frequency and because the excitation frequency is varying above and below frequency $F_c$, the actual oscillations in the tank circuit will be the resonant frequency $F_r$ amplitude modulated (AM) with the detection modulation frequency $F_d$ as shown in curve 20. Thus, although the excitation field for the resonant tag is not centered on its resonant frequency and is frequency modulated, the tank circuit itself will oscillate at its resonant frequency with an AM signal equal to $F_d$ and components of $F_d$. When the excitation field for the resonant tag is centered on its resonant frequency, and is frequency modulated with detection modulation frequency $F_d$, the components of $F_d$ will be especially high relative to $F_d$ (in particular the 2 $F_d$ harmonic).

Figure 3:
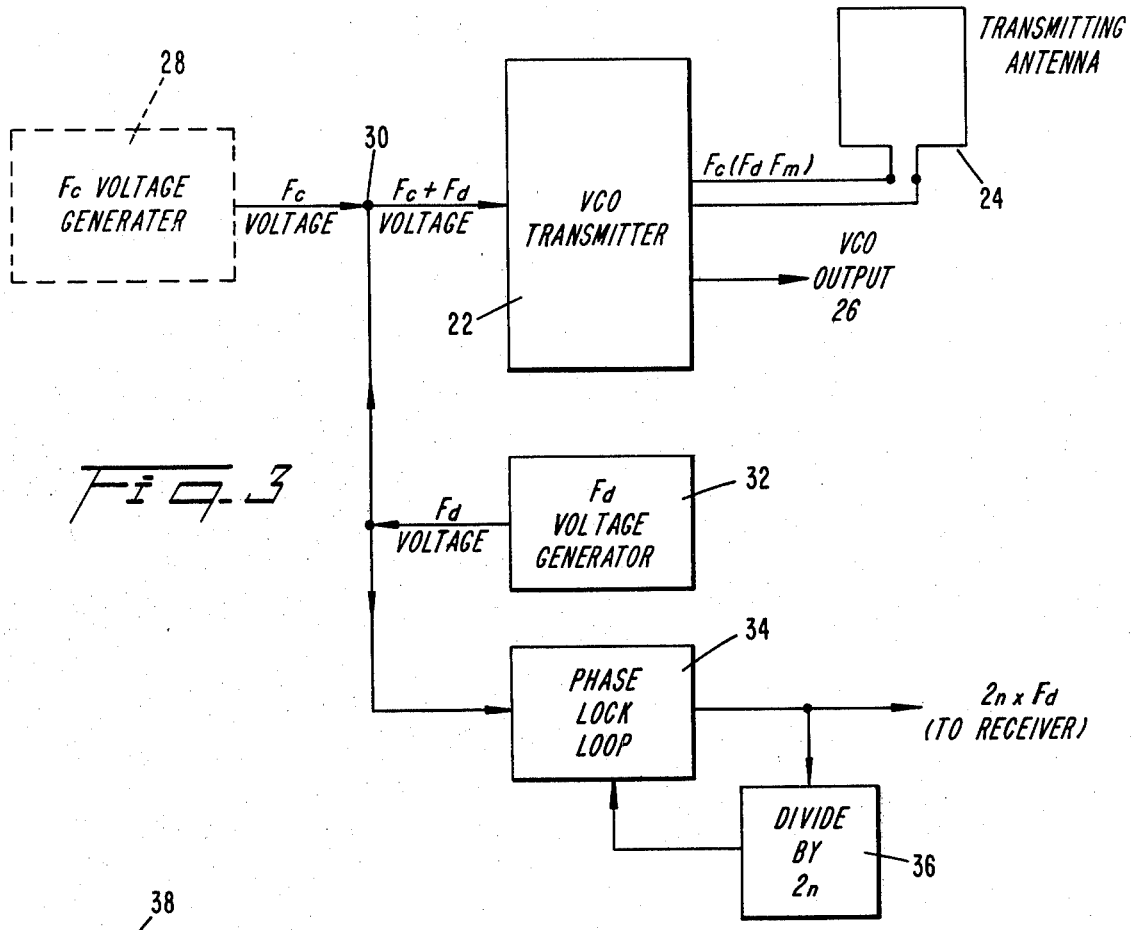
FIG. 3 is an electrical block diagram of the transmitter according to one embodiment of the present invention.

It is readily apparent that the dramatic changes in oscillation amplitude in the resonant tag will effect substantial changes in the electromagnetic field surrounding the resonant tag which changes can be detected by an appropriate receiver circuit. A suitable transmitter for such a frequency modulated electromagnetic field is shown in FIG. 3. A voltage controlled oscillator (VCO) in conjunction with suitable amplifiers forms a VCO transmitter 22. This provides the transmitting antenna 24 with a signal having a center frequency $F_c$ modulated by the detection modulation frequency $F_d$ and can also provide a VCO output 26.

The oscillation frequency of a voltage controlled oscillator is a function of the input control voltage to that oscillator. Thus, with a constant voltage, the voltage controlled oscillator will oscillate at a constant output frequency. As seen previously, it is desirable to have the transmitter provide variations in the output frequency where the frequency of the variations is equal to the detection modulation frequency $F_d$.

A center frequency ($F_c$) voltage generator 28 supplies a voltage to summing point 30 which is connected to the control input of the voltage controlled oscillator in the VCO transmitter 22. Without any other input, the $F_c$ voltage supplied by the $F_c$ voltage generator will cause the transmitter 22 to supply a frequency $F_c$ to the transmitting antenna.

However, also supplied to the summing point 30 is a detection modulation $F_d$ supplied by $F_d$ voltage generator 32. Thus, the voltage supplied to the control input of VCO transmitter 22 will be the sum of the $F_c$ voltage and the $F_d$ voltage which varies at the detection modulation frequency $F_d$. Thus, the output of transmitter 22 will be a frequency modulated signal which varies in frequency at a rate equal to $F_d$ and the output frequency has a center frequency equal to $F_c$.

The varying voltage output produced by $F_d$ voltage generator 32 is also supplied as an input to a phase locked loop 34 which produces an output at a frequency higher than $F_d$. The output is supplied to a receiver in one preferred embodiment and also to a divide-by-2N frequency divider network 36 whose output is fed back to phase locked loop 34. N could be any odd or even number or fraction thereof although in a preferred embodiment N is equal to 2. This means that a reference signal of $2N \times F_d$ is supplied to the receiver which is different from the detection modulation frequency $F_d$ which is to be detected.

The field transmitted by transmitting antenna 24 is received by receiving antenna 38 and fed to a bandpass filter 40 who has an output connected to AM detector 42. As seen in FIG. 2, the output of the AM detector will be the signal $F_d$ and harmonics thereof.

In a preferred embodiment noted with reference to FIG. 3 (N=2) the first harmonic is supplied from detector 42 to one input of synchronous detector 44. The other input to the synchronous detector is derived from the output of divide-by-2 frequency divider network 46 which divides the output from the phase locked loop 34 from the transmitter by 2. Thus, the received and detected AM signal is supplied to the synchronous detector along with a corresponding reference signal from the transmitter with the result that the output of the synchronous detector will be a DC voltage with a ripple frequency impressed thereon equal to variations, if any, in $F_c$. The use of a synchronous detector for verification of the detected AM signal, also provides protection against beat note signals from interfering transmitters in the frequency range of $F_c$.

Figure 4:
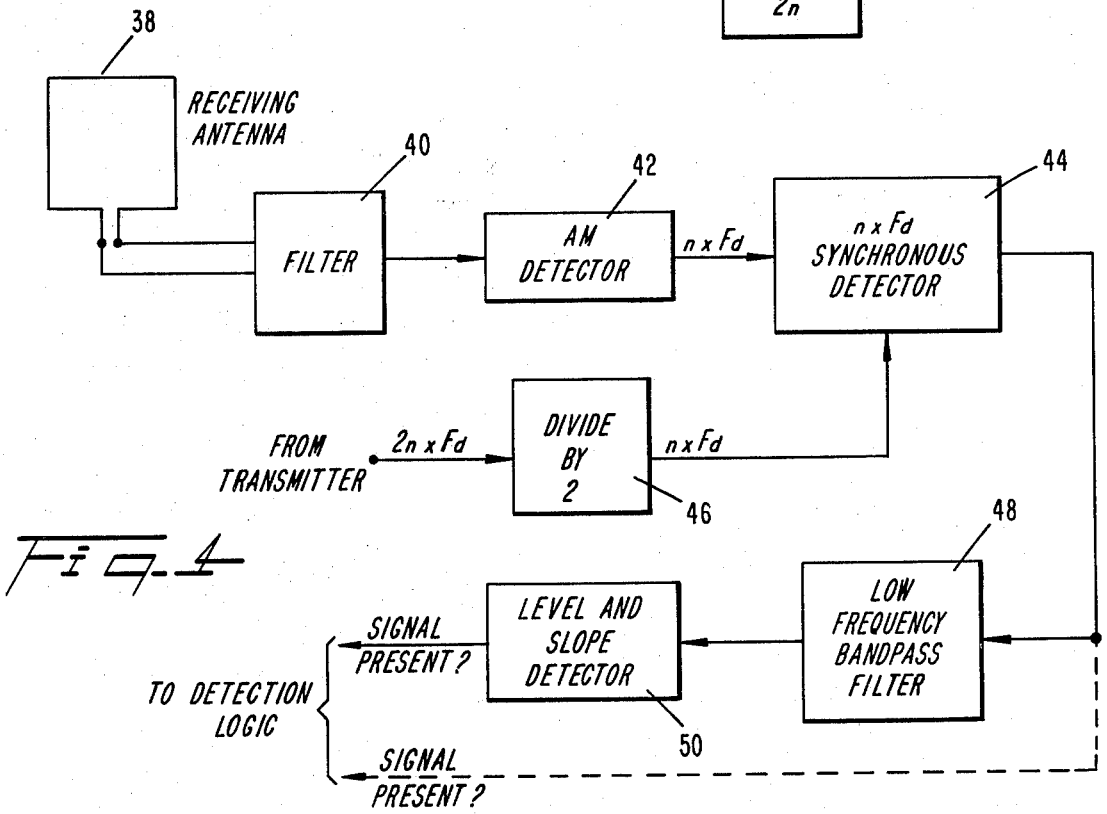
FIG. 4 is an electrical block diagram of the receiver according to one embodiment of the present invention.

As shown in FIG. 4, if the center frequency $F_c$ of the transmitter remains relatively constant, the DC voltage output from the synchronous detector could be used directly by the detection logic to indicate a signal being present (see the dotted line output from the synchronous detector). However, to further discriminate against spurious radiation and to enable detection of the presence of a resonant tag at a further distance from the receiving antenna, there are various embodiments of the present invention which utilize varying center frequencies $F_c$ which may vary in accordance with a sine wave, a sawtooth wave or a stepping staircase wave. All of these provide a ripple frequency which is impressed on the DC output of the synchronous detector when a tag is present in the vicinity of the receiving antenna. The frequency of this low frequency ripple is in direct relation to the sweep rate and sweep range of frequency $F_c$, and will be the same as the sweep rate when the sweep range of $F_c$ is properly chosen. Thus, the output of the synchronous detector may be passed through a low frequency bandpass filter 48 and applied to a level and slope detector 50. The low frequency bandpass filter removes any unwanted signals, (including the DC component), and passes the ripple frequency on to the level and slope detector. The level and slope detector examines the ripple frequency to determine its amplitude level and the slope of the signals applied thereto. Should these correspond to preset limits (which are characteristic of either a sine wave, a sawtooth or a stepping staircase) the output of the level and slope detector will indicate that a signal is in fact present to the detection logic.

Figure 5:
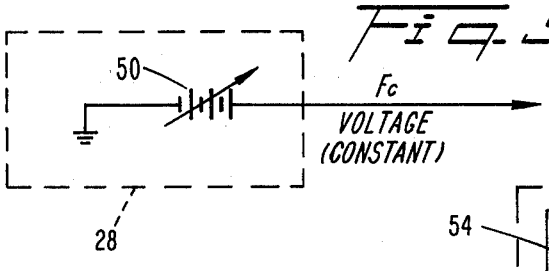
FIG. 5 is an electrical schematic of a portion of the transmitter shown in FIG. 3.
Figure 6:
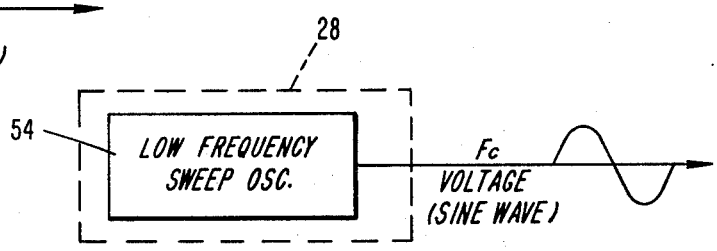
FIG. 6 is an electrical schematic of a portion of the transmitter shown in FIG. 3.

FIGS. 5–8 illustrate various embodiments of the center frequency voltage generator 28 which provide, respectively, a constant, a sine wave, a sawtooth, and a stepping staircase signal to summing point 30 of the transmitter. In FIG. 5 it can be seen that a variable power supply 52 is sufficient to supply the constant $F_c$ voltage output. FIG. 6 in one embodiment would utilize a low frequency sweep oscillator to provide a sine wave varying $F_c$ voltage. This frequency in a preferred embodiment would be within the range of 15 to 60 hz.

Figure 7:
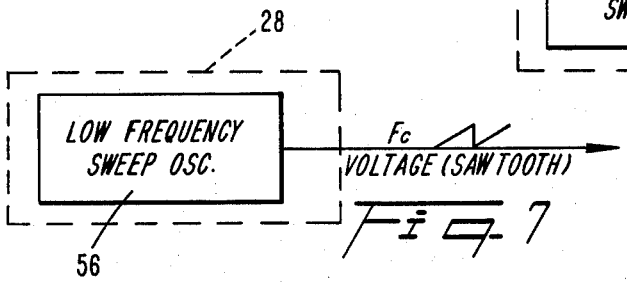
FIG. 7 is an electrical schematic of a portion of the transmitter shown in FIG. 3.
Figure 8:
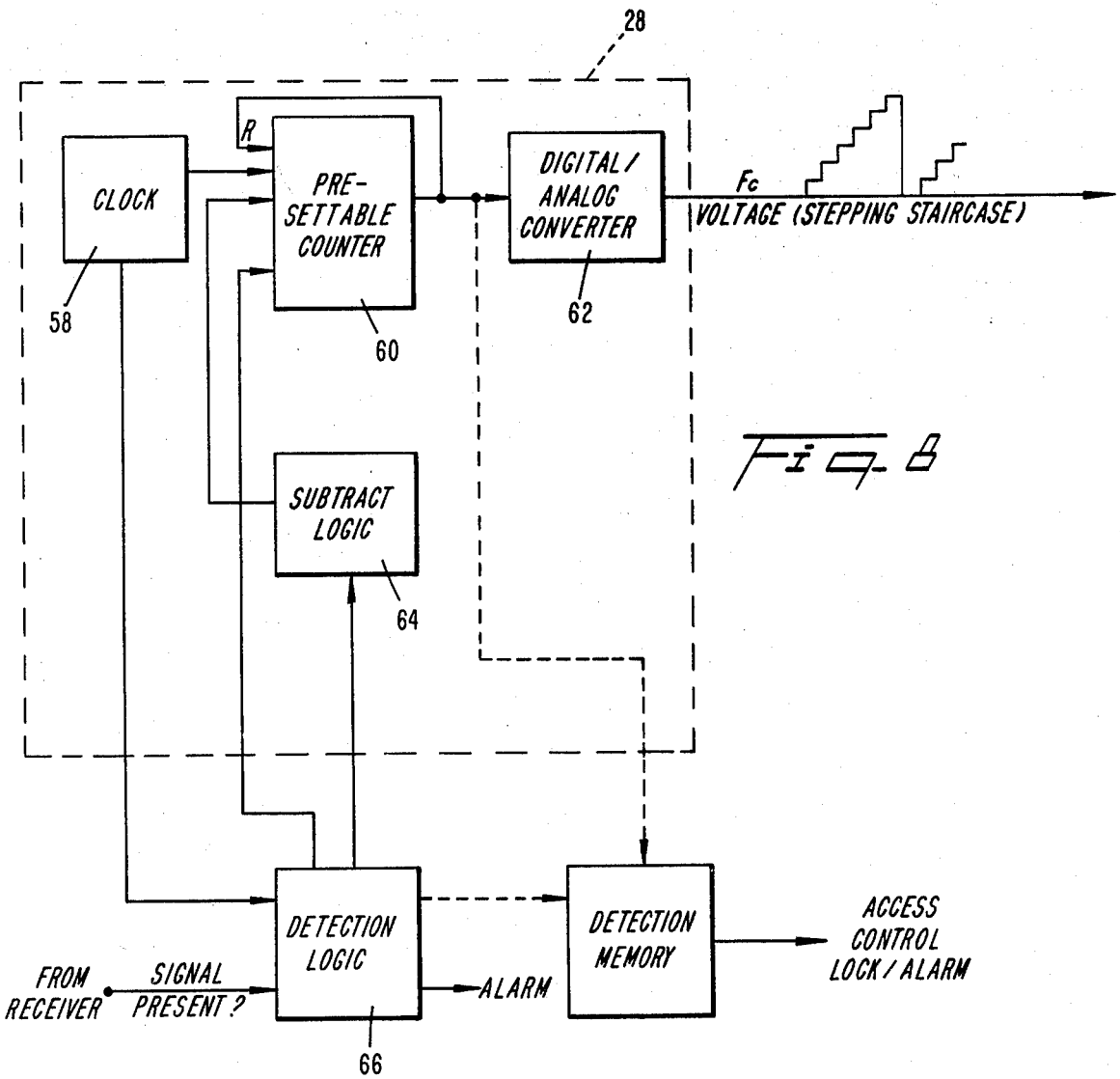
FIG. 8 is an electrical block diagram of a portion of the transmitter shown in FIG. 3 including the detection logic.

FIG. 7 shows another low frequency sweep oscillator 56 which provides a sawtooth output and can be used in the transmitter of FIG. 3. Again, the frequency of the sawtooth in a preferred embodiment would be within the range of 15 to 60 hz. FIG. 8 discloses an $F_c$ voltage generator 28 which provides a stepping staircase voltage output which means that the generator when used in conjunction with the transmitter shown in FIG. 3, would provide a transmitted output which periodically steps from one center frequency to another center frequency, all the time being modulated by the detection modulation frequency $F_d$. A simple clock circuit 58 provides timing pulses to a presettable counter 60 which effectively provides an output indicative of the present count therein. The output of counter 60 in a preferred embodiment is a digital signal which is processed in the digital/analog converter 62 to provide a voltage output indicative of the numerical count on the counter. As the counter is sequentially clocked, the output of converter 62 will be a stepping staircase output. In one preferred embodiment of the stepping staircase output $F_c$ voltage generator, there is further included a subtract logic circuit 64 which will cause the presettable counter to "backup" a preset number of steps.

Also shown in FIG. 8 is the detection logic circuitry 66 which comprises known combinations of coincidence circuits, gates, flip-flops, etc. to verify that the received signal present from the receiver is in fact the transmitted signal and not spurious electromagnetic radiation. Although a number of different possibilities exist within the scope of the FIG. 8 drawing, one preferred embodiment of the detection logic and center frequency generator 28 will now be discussed in detail.

The stepping staircase $F_c$ voltage means that the transmitter radiates for a predetermined period of time (in one embodiment 2 ms) and is then stepped to another (in the preferred embodiment higher) frequency for a similar period of time. It can be seen that as long as a resonant tag has its resonant frequency $F_r$ within the range through which the transmitter is stepped, at some point the transmitter field will be loaded by the tag resonations and the receiving antenna will pickup the disturbance in the field. Because the normal manufacturing tolerance for resonant frequency of the tags is $\pm 10\%$, in one embodiment, the median frequency will be chosen as 8.2 kHz$\pm$10%. Thus, the center frequency $F_c$ will be stepped from approximately 7.4 to 9 kHz. Sixty-four steps with a duration of 2 ms each may be in stepping from 7.4 to the 9 kHz frequency which gives a repitition or sweep frequency of approximately 8 Hz. The $F_d$ voltage generator 32 may be a 5 kHz oscillator which imposes a 5 kHz signal on the stepping staircase voltage which is applied to the transmitter 22. Thus, the transmitted electromagnetic field has a center frequency $F_c$ which is frequency modulated with a 5 kHz signal and periodically increases in center frequency from 7.4 kHz to 9.0 kHz.

As noted earlier, the 5 kHz signal is applied to the phase locked loop 34 which serves to amplify a 20 kHz (N=2) component which is supplied to the receiver. In the preferred embodiment, the receiver detects not the 5 kHz modulation but rather detects a component of this demodulation frequency which in this case happens to be the first harmonic at 10 kHz. The phase locked loop could just as easily provide a 10 kHz reference signal to the transmitter but because this is the frequency that is being detected and there is always some level of intercircuitry coupling, it has been found helpful to have the reference signal at a substantially higher frequency than that of the demodulation frequency $F_d$.

Referring back to FIG. 2, it will be seen that as the center frequency $F_c$ of the transmitter is stepped from a lower to a higher frequency it will move from the left to the right on the response curve. It can also be seen that when $F_c$ is at one of the steeper portions of the response curve, the highest amplitude modulation will occur in the resonant tag. The variations in resonation amplitude in the resonant tag will be picked up as perturbations in the electromagnetic field by the receiving antenna and after filtering will be applied to the AM detector. The output of the detector could easily be the demodulation frequency $F_d$ although in a preferred embodiment it is desirable to use a component of the demodulation frequency such as the first harmonic. In the present instance, the first harmonic of the 5 kHz signal will be 10 kHz (N=2) which is supplied as one input to the synchronous detector. It should be noted that nowhere in the transmitted signal is there a 10 kHz signal and thus this signal is due only to the presence of the resonant tag and its operation upon the 5 kHz frequency modulated center frequency. The magnitude of the 10 kHz signal depends on the location of the center frequency $F_c$ with regard to the response curve of the tag. When the center frequency $F_c$ of the transmitter is at the top of the response curve, i.e. coincides with $F_r$, the highest first harmonic (10 kHz) will be present.

The transmitter supplies the 20 kHz reference signal to the divide-by-2 frequency divider network which supplies a reference 10 kHz signal to the other input of the synchronous detector. When both inputs are present at the same frequency, a DC output is provided from the synchronous detector. This DC will have a given value at one frequency $F_c$ and a slightly different value at the next "stepped" frequency $F_c$. The low frequency bandpass filter will eliminate the DC voltage but will pass the low frequency variations which are due to the stepping of the center frequency $F_c$ in the transmitter. The low frequency is determined by the stepping rate and sweep range of frequency $F_c$. Different orientations of the tag in the electromagnetic field results in phase-shifts of this low frequency signal, but not in frequency changes. The lever and slope detector 50 compares both the absolute level of the low frequency signal and the slope of the signal between respective "stepped" center frequencies and provides an output when there is a sufficient level or enough of a slope to indicate the presence of a resonant tag in the vicinity of the receiving antenna.

The signal from the level and slope detector is supplied to the detection logic 66 shown in FIG. 7 which causes an output to clock the presettable counter 60 one or more additional step. Presuming that there is still a signal present after the transmitter has been clocked one or more additional step, the subtract logic 64 causes the presettable counter to reverse a predetermined number of steps which in a preferred embodiment is equal to six. Thus the counter "backs up" six steps and begins stepping again. This "backing up" can continue a predetermined number of times or the transmitter or detection modulation frequency $F_d$ can be turned on and off in a predetermined sequence to verify that the signal present from the receiver is in fact due to the presence of a resonant tag in the predetermined area. This identification sequence eliminates any possibility of false alarms due to spurious radiation and therefore makes the present system very attractive from a security standpoint.

Figure 9:
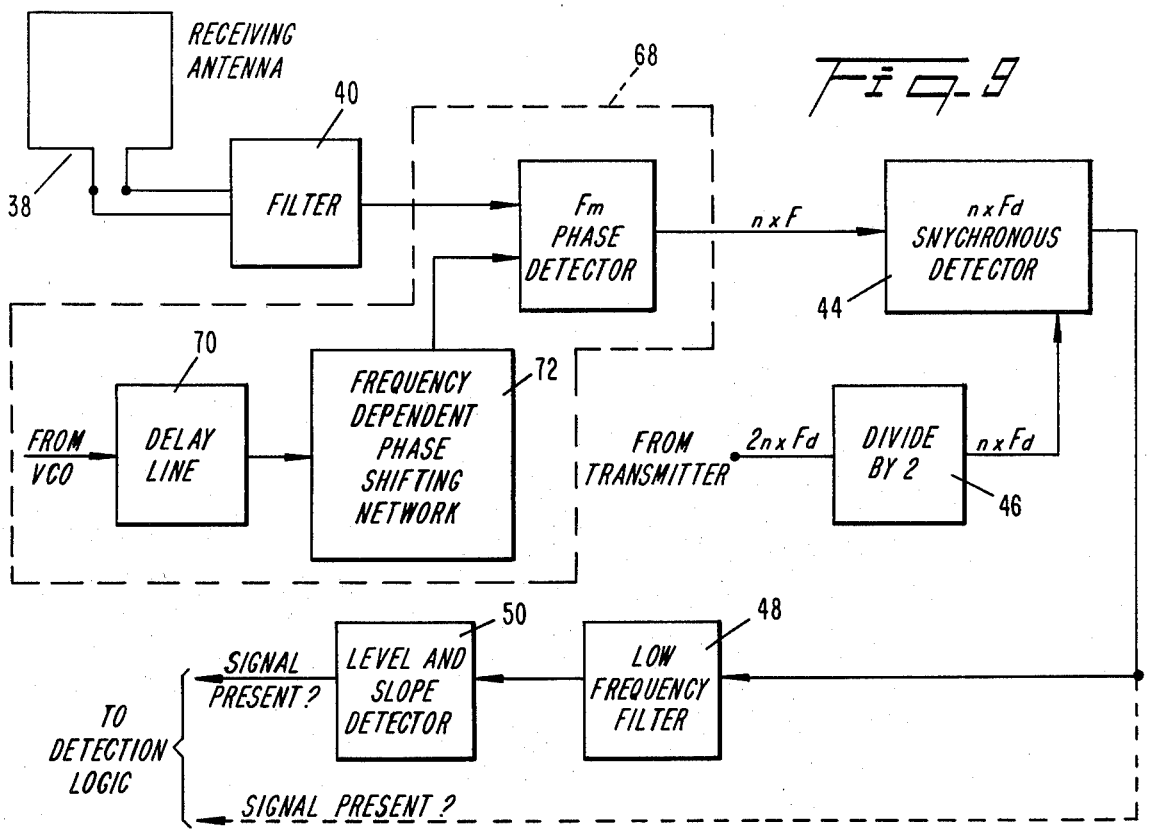
FIG. 9 is an electrical block diagram of a further embodiment of a receiver in accordance with the present invention.

The above discussed embodiments all used an AM detector in the receiver to obtain the demodulation frequency $F_d$ or its desired harmonic. However, FIG. 9 is identical to FIG. 4 with the circuitry in dotted line block 68 providing the equivalent of the AM detector 42 in FIG. 4. The center frequency $F_c$ which is frequency modulated with $F_d$ is supplied from the voltage controlled oscillator to delay line 70 which then supplies a slightly delayed output to the frequency dependent phase shifting network 72. The phase of the center frequency $F_c$ is varied by the network in accordance with the variations in frequency caused by the frequency modulation of the center frequency by $F_d$. The output of network 72 will be the modulated center frequency with a phase shift which varies according to $F_d$. This signal and a signal from the receiving antenna and filter 40 are applied to an FM phase detector 74 which supplies the component output which is desired which in a preferred embodiment is the first harmonic of $F_d$. This signal is then applied to the synchronous detector which operates in the same manner as FIG. 4.

There are a number of modifications to the above described security system which will be readily apparant to those of ordinary skill in the art in view of the above teachings. For example, the number of transmitter or $F_d$ generator on/off sequences or the number of reverse stepping sequences could be arranged to further protect the security system against false alarms. While the detection modulation frequency $F_d$ could be used, preferred embodiments utilize harmonics thereof although combinations of $F_d$ and selected harmonics thereof could be utilized to guard against false alarms. When a preset level of $F_d$ is reached and an output is supplied from the level and slope detector to the detection logic circuit, which in one embodiment steps $F_c$ forward one or more steps to see if a larger level of $F_d$ is subsequently present, the detection logic could just as easily step the $F_c$ voltage generator backward one or more step to see if a slightly lower level of $F_d$ is still present.

Furthermore, it may be desirable to have a resonant tag with two or more separate resonant circuits thereon to even further avoid false alarms. This could have the additional benefit that it could act as an identity card or an access card. In this instance, and in view of the above discussion, it will be obvious to one of ordinary skill in the art to utilize a simple memory to determine whether the desired two or more resonant frequencies are present before permitting access. Such a modification is shown in FIG. 8 wherein the dotted line outputs of the detection logic 66 and a presettable counter 60 provide information as to the presence of a resonant tag and its frequency to a detection memory 67. This information is compared to a stored code of frequencies and if there is a match of sequences and/or frequencies, access to the secured area is provided. If at least one resonant frequency is present but there is no match then an alarm could be sounded. Thus an identity card equipped with resonant tags could provide access to a security area to only selected individuals in an easy and secure manner.

Figure 10:
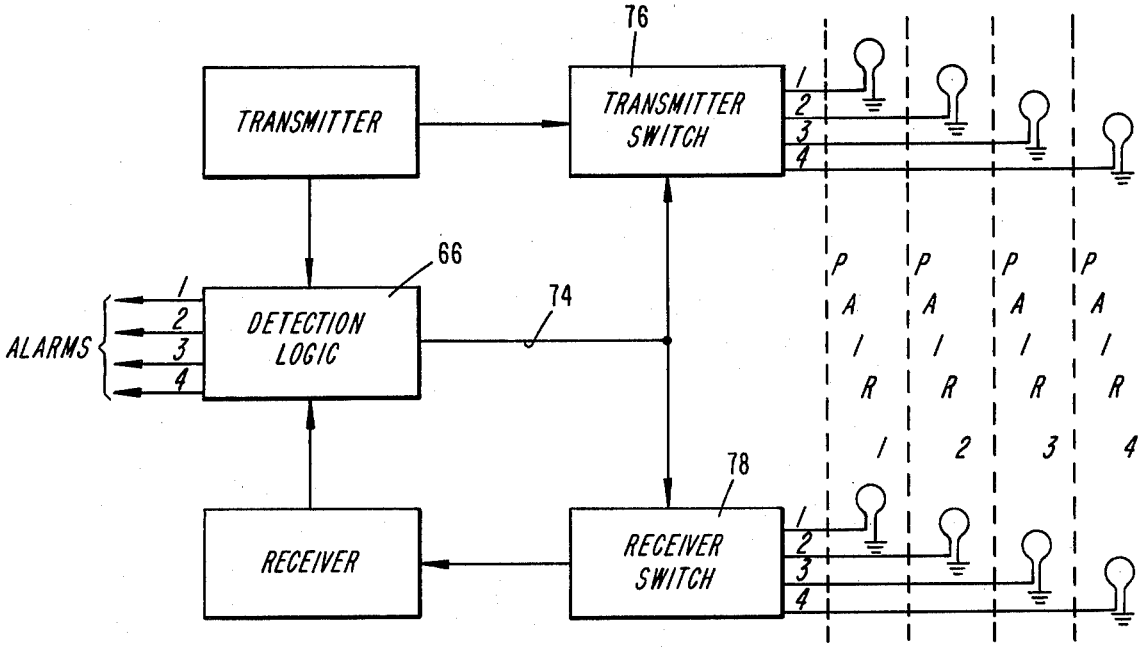
FIG. 10 is an electrical block diagram of a further embodiment of the security system according to the present invention.

Furthermore, because several embodiments of the present invention sweep through a range of center frequencies, quality control on individual tags does not have to be as high as with present security systems thus reducing the tag cost. The security system cost can be further reduced by operating a plurality of antennas which are sequentially connected to the transmitter and receiver in accordance with a predetermined pattern. Such an embodiment is shown in FIG. 10 where the detection logic receives a clock signal, in one embodiment from the transmitter, which connects the transmitter and receiver to selectively different antennas. A switching signal on line 74 causes transmitter switch 76 and receiver switch 78 to selectively connect the transmitter and the receiver to their respective associated antennas for a predetermined period of time. In one embodiment each antenna would be connected to the system for one full stepping staircase signal and would then be switched off. Thus a plurality of antennas could protect a number of entrances and exits with only a single security system. This time multiplexing greatly enhances the economy of such security systems.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of the invention in which an exclusive property or privilege is claimed are defined as follows:

1. An electronic security system comprising:

transmitter means for providing an electromagnetic field in a predetermined area by transmitting a signal at a center frequency $F_c$, said signal being frequency modulated by a detection signal at a detection modulation frequency $F_d$ and said center frequency being swept through a range of frequencies;

a resonant tag circuit having at least one resonant frequency within said range of frequencies;

receiver means for detecting a signal having a frequency which is at least a component of said detection modulation frequency $F_d$ in said predetermined area; and detection logic means for providing an alarm in response to detection of said signal having a frequency which is at least one component of said detection modulation frequency $F_d$.

2. The security system according to claim 1, wherein said receiver means for detecting said component of said detection modulation frequency $F_d$ includes an FM phase comparison means for comparing the phase of a received signal with the phase of the transmitted signal providing the electromagnetic field.

3. The security system according to claim 1, wherein said receiver means includes an AM detector detecting said component of said detection modulation frequency $F_d$.

4. The security system according to claim 1 wherein said range of transmitter frequencies is generated in accordance with a sine wave signal.

5. The security system according to claim 1, wherein said range of transmitter frequencies is generated in accordance with a sawtooth signal.

6. The security system according to claim 1, wherein said range of transmitter frequencies is generated in accordance with a stepping staircase signal.

7. The security system according to claim 6, wherein said receiver includes means responsive to detection of a signal at a frequency equal to said component of said detection modulation frequency for turning said electromagnetic field on and off in a predetermined pattern; and said detection logic provides an alarm only in response to detection of said detection modulation frequency $F_d$ in said predetermined on and off pattern.

8. The security system according to claim 6, wherein said receiver includes means responsive to detection of a signal at a frequency equal to said component of said detection modulation frequency for stepping said transmitter one or more additional frequency step.

9. The security system according to claim 8, wherein said receiver includes means responsive to detection of a signal at a frequency equal to said component of said detection modulation frequency $F_d$ for turning at least said detection signal on and off in a predetermined pattern; and said detection logic provides an alarm only in response to detection of said detection modulation $F_d$ in said predetermined pattern.

10. The security system according to claim 3, wherein said component of said detection modulation frequency $F_d$ is a signal having a frequency $F_d$.

11. The security system according to claim 3, wherein said component of said detection modulation frequency $F_d$ is a signal having a frequency equal to an upper harmonic of $F_d$.

12. The security system according to claim 3, wherein said component of said detection modulation frequency $F_d$ is a signal having a frequency equal to twice the detection modulation frequency $F_d$.

13. The security system according to claim 6, wherein said transmitter means includes clock pulse means, a binary counter connected to the output of said clock pulse means, a digital-to-analog converter responsive to said counter, said converter providing a frequency controlling stepping staircase signal.

14. The security system according to claim 6 or 10, wherein, upon detection of a signal at a frequency equal to said component of said detection modulation frequency, said detection logic means resets said transmitter means backward a predetermined number of steps and restarts said stepping staircase signal.

15. The security system according to claim 1, wherein said resonant tag has at least two resonant frequencies and said system further includes detection memory means for comparing frequencies of actual detection of signals with a predetermined number and range of frequencies and providing an output indicative of said comparison.

16. The security system according to claim 15, wherein said memory means further includes means for providing access to a security area when said frequencies of actual detection match said predetermined number and range of frequencies and for providing an alarm when said frequencies of actual detection do not match said predetermined number and range of frequencies.

17. The security system according to claim 1, wherein said transmitter means includes a transmitter, a plurality of antennas and a transmitter switch, said receiver means includes a receiver, a plurality of antennas forming a plurality of antenna pairs with said plurality of antennas in said transmitting means, and a receiver switch, said detection logic means includes means for activating said switches to alternately connect said transmitter and said receiver to individual pairs of said antennas, said detection logic means includes means for indicating which of said pairs of antennas are connected to said transmitter and said receiver and for activating an alarm should said one component of said detection modulation frequency $F_d$ be detected at one of said pairs of antennas, said alarm indicative of which of said pairs has detected said one component.

18. The security system according to claim 2 or 3, wherein said receiver means includes a synchronous detector for verification of said component of said detection modulation frequency $F_d$.

19. The security system according to claim 1, wherein said receiver includes a synchronous detector followed by a low frequency bandpass filter for verification of said component of said detection modulation frequency $F_d$ and a low frequency signal resulting from the sweep of said center frequency.

20. An electronic security system comprising:

transmitter means for providing an electromagnetic field in a predetermined area by transmitting a signal at a center frequency, said signal being frequency modulated by a detection signal at a detection modulation frequency;

a resonant tag circuit having at least one resonant frequency close to said center frequency, and having an amplitude versus frequency response characteristic whereby excitation of said tag circuit by said center frequency signal modulated by said detection signal produces a resonant signal at said resonant frequency which is amplitude modulated at a frequency which is a single component of said detection modulation frequency; and detection logic means for providing an alarm in response to detection of said single component of said detection modulation frequency.

21. The security system according to claim 20, wherein said single component is a second harmonic.

22. The security system according to claim 20, wherein said receiver means includes a synchronous detector for verification of said single component of said detection modulation frequency.

* * * * *